US006095664A

United States Patent [19]

Wang

[11] Patent Number: 6,095,664

[45] Date of Patent: Aug. 1, 2000

[54] ORNAMENTAL LAMP

[76] Inventor: Yu-Ting Wang, P.O. Box 82-144, Taipei, Taiwan

[21] Appl. No.: 09/013,306

[22] Filed: Jan. 26, 1998

[51] Int. Cl.[7] ..... F21M 3/14

[52] U.S. Cl. ..... 362/255; 362/806; 362/808

[58] Field of Search ..... 362/255, 806, 362/807, 808; 313/116

[56] References Cited

U.S. PATENT DOCUMENTS 3,818,213 6/1974 Rochford et al. ..... 362/806

*Primary Examiner*—Stephen Husar

*Attorney, Agent, or Firm*—A & J

[57] ABSTRACT

An ornamental lamp having a lamp bulb, and an ornament directly molded from a polymer around the bulb of the lamp bulb and colored, permitting the lamp base of lamp bulb to be extended out of the ornament for connection to an electric socket, light from the lamp bulb passing through the ornament in different directions when the lamp bulb is turned on.

1 Claim, 2 Drawing Sheets

ORNAMENTAL LAMP

BACKGROUND OF THE INVENTION

The present invention relates to an ornamental lamp, and more particularly to such an ornamental lamp which comprises a lamp bulb, and a polymeric ornament directly molded on the bulb of the lamp bulb.

An ornamental lamp for a decorative string or Christmas tree light set is simply a lamp bulb comprised of a lamp base and a colored bulb on the lamp base. This structure of ornamental lamp is less attractive.

SUMMARY OF THE INVENTION

The present invention provides an ornamental lamp for a decorative string or Christmas tree light set which comprises a lamp bulb, and a polymeric ornament mounted around the bulb of the lamp bulb by molding. The polymeric ornament is colored with desired colors, and admits light. Light passes through the ornament in different directions when the lamp bulb is turned on.

DETAILED DESCRIPTION OF THE PREFERRED EMBODIMENT

Figure 1:
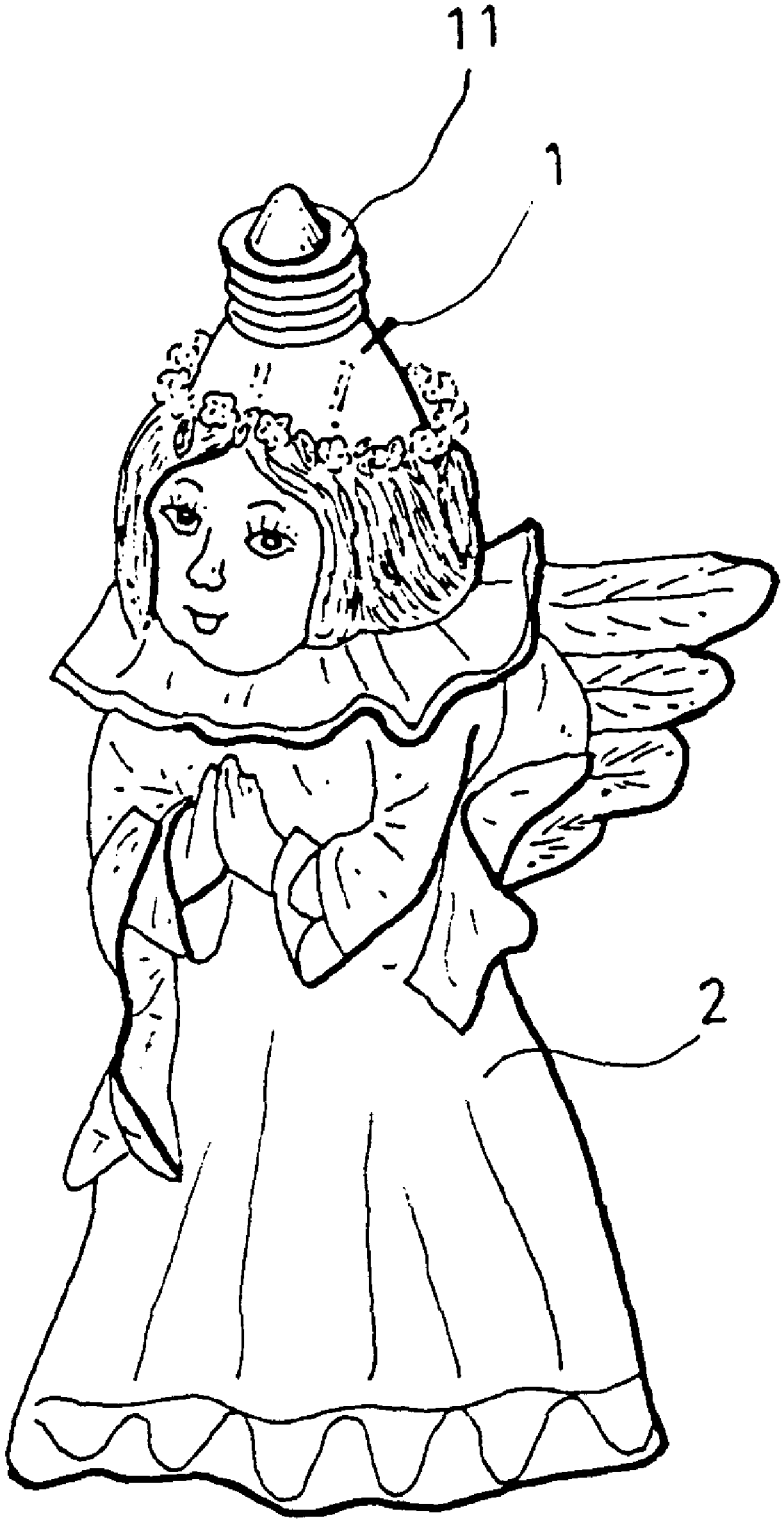
FIG. 1 is a perspective view of an ornamental lamp according to the present invention.
Figure 2:
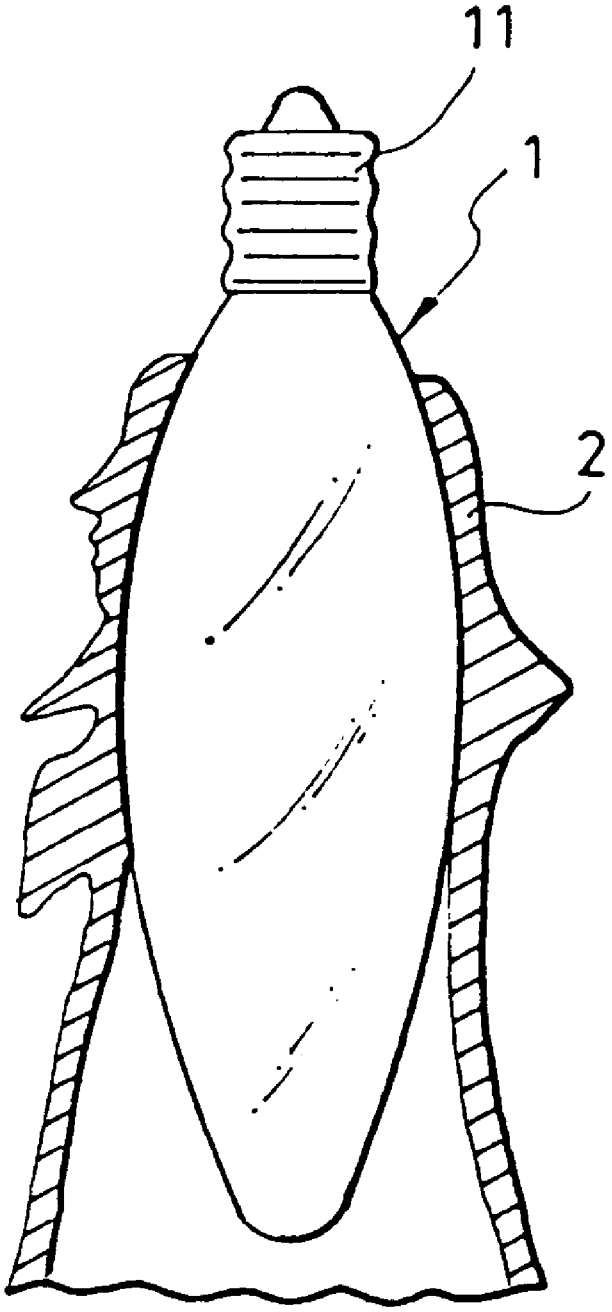
FIG. 2 is a sectional view of the ornamental lamp shown in FIG. 1.

Referring to FIGS. 1 and 2, an ornamental lamp in accordance with the present invention is comprised of a lamp bulb 1, and an ornament 2.

The ornament 2 is directly molded from polymer on the lamp bulb 1, having a particular design, for example, the shape of an angle. During fabrication, the lamp bulb 1 is put in a molding mold of a particular design, then a liquid polymer is filled into the mold and molded into shape around the lamp bulb 1. After molding, the ornament 2 is painted with different colors. The lamp base 11 of the lamp bulb 1 extends out of the ornament 2 for connection to an electric socket. The ornament 2 admits light, and serves as a lamp shade. When the lamp bulb 1 is turned on, light penetrates the ornament 2, producing a fantastic lighting effect. Alternatively, the ornament 2 can be molded from a light-tight polymer and covered over the lower part of the bulb of the lamp bulb, so that light passes out of the top side of the ornament 2 through the neck of the bulb of the lamp bulb 1.

While only one embodiment of the present invention has been shown and described, it will be understood that various modifications and changes could be made thereunto without departing from the spirit and scope of the invention disclosed.

What is claimed is:

1. An ornamental lamp comprising an lamp bulb having a bulb and a lamp base at one end of the bulb for connection to an electric socket to obtain electricity from said electric socket, and an ornament mounted on said lamp bulb, wherein said ornament is molded from a light-tight polymer and covered over a lower part of the bulb of said lamp bulb opposite to said lamp base and colored, permitting light to pass from said lamp bulb out of an upper part of the bulb of said lamp bulb, the lamp base of said lamp bulb extending out of said ornament for connection to an electric socket.

* * * * *